US007188579B2

(12) United States Patent
Lemonides

(10) Patent No.: US 7,188,579 B2
(45) Date of Patent: Mar. 13, 2007

(54) MOORING POLE LINE ATTACHMENT DEVICE

(76) Inventor: Dimitri J. Lemonides, 153 Jeffery La., Oceanside, NY (US) 11572

( * ) Notice: Subject to any disclaimer, the term of this patent is extended or adjusted under 35 U.S.C. 154(b) by 0 days.

(21) Appl. No.: 11/026,791

(22) Filed: Dec. 31, 2004

(65) Prior Publication Data

US 2006/0144310 A1 Jul. 6, 2006

(51) Int. Cl.
*B63B 21/04* (2006.01)

(52) U.S. Cl. ..... 114/230.2; 114/230.27

(58) Field of Classification Search ..... 114/230.1, 114/230.2, 230.26, 230.27
See application file for complete search history.

(56) References Cited

U.S. PATENT DOCUMENTS 2,938,492 A * 5/1960 Kulick ..... 114/230.18
3,430,598 A * 3/1969 Soderberg ..... 114/230.27
3,486,342 A * 12/1969 Aks ..... 405/212
3,997,150 A * 12/1976 Hanson et al. ..... 267/140
4,357,891 A * 11/1982 Sluys ..... 114/230.27
4,445,806 A 5/1984 Crain
4,512,683 A 4/1985 Cosenza
5,467,727 A 11/1995 Godvin et al.
5,603,280 A 2/1997 Shackelford, Jr.
5,762,016 A 6/1998 Parsons et al.
5,937,781 A * 8/1999 Isella et al. ..... 114/230.26

* cited by examiner

*Primary Examiner*—Sherman Basinger
(74) *Attorney, Agent, or Firm*—Richard L. Strauss, Esq.

(57) ABSTRACT

A mooring pole line attachment device is disclosed comprised of a buoyant base, cylindrical sleeve, the cylindrical sleeve having circumferential rings utilized for engagement of a line. The buoyant base includes an outer cover, inner coil and is filled with a buoyant material. The base also includes a central bore therethrough having a diameter sufficient to receive the cylindrical sleeve therewithin and to allow the base to be affixed to the sleeve so that inferior termini of both base and sleeve align. The cylindrical sleeve is a tubular structure having a central bore of a sufficient diameter to allow placement of the device upon a mooring pole and to allow for sliding thereupon. The sleeve includes parallel, circumferential rings and grooves utilized as attachment points for mooring ropes. The device is placed upon a mooring pole and, due to its buoyancy, floats and thereby adjusts its position upon the pole in accordance with changes in water level. The device thus provides a point of mooring line attachment for a boat the moves up and down with changing tides while additionally providing protection for both boat and mooring pole from collision therebetween.

18 Claims, 9 Drawing Sheets

MOORING POLE LINE ATTACHMENT DEVICE

TECHNICAL FIELD

The device and method disclosed herein relate generally to marine mooring systems. More specifically, the disclosed device and method of use thereof relates to enhanced utilization of mooring poles for securing maritime vehicles such as boats thereto.

BACKGROUND OF THE ART

It is well known that the mooring of boats (and other marine vehicles) to mooring poles is often complicated by changing tides. In some areas, such changes in tides—from low tide to high tide—may be so great as to make mooring boats to stationary poles and docks highly difficult and, in some cases impossible. For example, a boat may be moored to one or more mooring piles with a safe and reasonable amount of mooring line at low tide, only to be allowed to drift dangerously far from such anchorage as the tide rises. In contrast, a boat tied securely to a mooring post at high tide, with a minimum play of line, may be dangerously tilted, damaged and/or capsized as low tide approaches and the boat becomes suspended by one or more cleats.

U.S. Pat. No. 5,603,280 discloses a boat mooring system including a track mounted to a piling. A carriage is mounted for movement within the track and an elongated rod is connected to the carriage. A float is mounted to the lower end of the rod allowing the entire assembly to move up and down. A mooring ring, attached to the movable (vertically) carriage allows a boat to be tied to the pile at a safe distance as the attachment point (ring) height follows changes in water levels associated with the tide. However, the aforementioned mechanism disclosed in U.S. Pat. No. 5,603,280 is relatively complex, includes small moveable parts in contact with a marine environment and thus is subject to mechanism failure due to environmental factors such as debris, corrosion and temperature extremes.

U.S. Pat. No. 5,762,016 (the "'016 patent") discloses a dock pole bumper assembly utilized for securing a boat to a mooring pole. The assembly includes a stationary track arranged and secured vertically to a mooring pole. A moveable portion includes a carriage-like structure that engages the stationary track via guide channels. The carriage-like structure is faced with a flexible/deformable material. Mooring cleats are mounted on the side of the carriage-like structure and are utilized for securing the side of a boat directly against the flexible/deformable structure. As discussed above in regard to U.S. Pat. No. 5,603,280, the '016 includes relatively complex parts subject to jamming and/or seizure due to environmental factors. The '016 patent also requires the subject boat to be moored directly upon the mooring pole.

SUMMARY OF THE INVENTION

Now, in accordance with the present invention, a mooring pole line attachment device is disclosed providing safe mooring of a boat or other marine vehicle to a mooring pole by continually adjusting the height of line attachment points thereupon with changes in water level. In addition, the mooring pole line attachment device of the present invention provides protection of mooring poles from rough contacts with boats moored thereto, while simultaneously affording protection to said boats. The mooring pole line attachment device of the present invention is comprised of a buoyant base, cylindrical sleeve and at least one line engagement means.

The buoyant base is tubular in configuration and includes an outer surface and an inner core surrounding and defining a central bore. The outer surface of the buoyant base is advantageously covered by a tough, resilient outer cover, such as, for example, a polyvinyl, polyolefin, polypropylene, polyester, polyurethane or nylon composition. The cover may also be fabricated from a natural or synthetic (e.g. nitrile) rubber compound. The cover may be fabricated of one or more sections and tied (or otherwise affixed) to the outer surface of the buoyant base. The base cover runs from the inferior to superior termini of thereof. However, the central bore of the base is open on both the superior and inferior termini thereof. The inner core of the buoyant base may advantageously include an inner coil comprised of a circumferential polyethylene, polyvinyl or polyester hollow tube positioned within the core. Additionally, the core of the buoyant base is filled with a buoyant material such as, for example, thermoplastic foams such as, for example, a polystyrene, poly(vinyl chloride) (PVC), polyolefin (polyethylene and polypropylene) or ABS foam. Also, the buoyant material may comprise a thermoset foam such as, for example, polyurethane (also called urethane), phenol-formaldehyde (phenolic), urea-formaldehyde and epoxy foams.

It is especially advantageous to select closed-cell, rigid, low-density foam as the buoyant material as such foams generally demonstrate good buoyancy characteristics. In closed cell foams, each cell behaves as an individual float. The initial buoyancy factor of plastic foam is equal to the density of the liquid (in this instance, water) on which it floats less the density of the foam. For example, 1 cubic foot of plastic having a density of 2 pounds per cubic foot (2 $lb/ft^3$) will support a load equal to 60.5 $lb/ft^3$ [62.5 $lb/ft^3$ (density of water)—2.0 $lb/ft^3$]. Naturally, as plastic foam absorbs water, the density of the foam will increase and foam buoyancy will decrease in kind. Thus, it is advantageous to utilize closed cell foam as the buoyant material within the buoyant base. Any closed cell foam exhibiting a specific gravity less than that of water—or, a density less than that of water (62.5 pounds per cubic foot) will exhibit buoyancy. However, it is preferred that the buoyant foam material within the buoyant base demonstrate a density of from about 0.1 to about 60 $lb/ft^3$. It is still further preferred that such foam be selected to have a density of from about 1.5 to about 2.5 $lb/ft^3$.

As mentioned above, the buoyant base defines a substantially tubular, or, as it may be better described, a "donut-like" shape including an inner bore. The inner bore of the buoyant base is affixed to an inferior terminus of the cylindrical sleeve of the device. The cylindrical sleeve is comprised of a hollow tubular structure with an outer surface and an inner surface defining a central bore. The outer surface of the cylindrical sleeve is shaped and configured to include a plurality of continuous parallel annular rings arranged circumferentially thereabout. More specifically, the outer surface of the sleeve includes parallel, circumferential rings with grooves therebetween referred herein, collectively, as annular rings. In contrast, the inner surface of the cylindrical sleeve defines a relatively smooth surface. The cylindrical sleeve may be fabricated of any marine quality material such as, for example, an ABS, polyvinyl, polyether, polyurethane, polypropylene, polyolefin, or polyester plastic. The sleeve may be also fabricated from a natural rubber or a synthetic rubber such as, for example, a nitrile rubber. The cylindrical sleeve includes an inferior (also referred to herein as "proximal" and superior (also referred to herein as "distal") terminus. The inferior terminus of the sleeve and the diameter of the inner bore of the buoyant base are especially configured so that the outer surface of the columnar sleeve will mate with the central bore of the base thereby allowing ease of fixation of the base to the proximal terminus of the tube via, for example injection and curing of the above-described polystyrene core material into the base during fabrication of the device (discussed in greater detail below).

The smooth inner surface of the cylindrical sleeve (and the central bore defined thereby) demonstrates an inside diameter especially sized and configured so as to allow the device (with cylinder attached to base) to slide easily over a mooring pole. The smooth inner surface of the cylindrical sleeve runs from the proximal (inferior) to the distal (superior) terminus of the device thereby allowing the entire device to be placed upon and slide up and down a mooring pole.

The circumferential grooves of the cylindrical sleeve serves two distinct purposes. During the fabrication of the mooring pole device, the outer surface of an inferior portion of the sleeve is passed through the central bore of the buoyant base section prior to injection of foam into the inner core of the base. At this point in the fabrication process, the buoyant base includes the above-described outer cover, an inner circumferential coiled tube (similar to the columnar sleeve, but of a more diminutive diameter). The coiled tube within the base defines a central bore of a dimension sufficient so as to allow the sleeve to fit therewithin, substantially flush with the proximal (inferior) terminus thereof. The outer surface of the inner coil may advantageously include a plurality of annular rings (or, as they may also be referred to, parallel circumferential rings and grooves). In certain preferred embodiments of the present invention, polystyrene (or other suitable buoyant) foam is advantageously injected into the base an fills both the base and the outer annular rings of the sleeve thereby effectively affixing one to the other.

The annular rings of the present device also provide line tied points of varying heights (in regard to water level) so as to accommodate boats of varying sizes and freeboard dimension. For example, and as shown in greater detail below, the device of the present invention may include a line engagement means comprised of an adjustable rope tied circumferentially about a selected annular groove. The adjustable rope may be configured to include one or more loops through which mooring lines may be past in order to secure a boat. The adjustable rope is tied so as to allow it to be moved superiorly or inferiorly within selected circumferential grooves located along the outer sleeve so as to accommodate the afore-mentioned varying boat dimensions. Mooring lines may be tide directly about any selected parallel, circumferential groove. In such instances, the aforementioned adjustable rope (and loops thereupon) may be utilized as utility and/or emergency grab handles which assist individuals in the water or assist in providing a temporary grab handle for boaters who are affixing a line about the sleeve as discussed above. In order that the cylindrical sleeve be capable of accommodating boats of varying freeboard height (and to provide a range of circumferential groove heights for proper mooring thereof, it is preferred that the cylindrical sleeve be from about 3 feet to about 10 feet in length. It is still further preferred that the sleeve be from about 4 feet to about 8 feet in length.

The device may optionally include a mooring line storage device such as, for example, a simple velcro or snap lock nylon strap affixed near the superior portion of the device so as to allow mooring lines to be left high and dry at the pole.

A preferred embodiment of the present invention provides a method of mooring a boat to a mooring pole wherein both boat and mooring pole are protected from damage due to collision therebetween. In addition, said method provides a means for compensating for changes in tide height (water level) by providing continual adjustment of mooring line fixation point(s) upon a mooring pole in accordance with such changes in water level. In a preferred embodiment of the method of the present invention, the above-described mooring pole device is prepared for use by mounting said device upon a mooring pole. More specifically, the central bore adjacent the proximal (inferior) terminus of the device is aligned with a selected mooring pole and thereafter the entire device is slid down upon a mooring pole, (the central bore of the device being configured to fit about such a pole). Upon contact of the buoyant base of the device with water surrounding the pole, the device begins to float. Thereafter, an annular ring is selected for placement of the aforementioned adjustable rope depending upon the freeboard height of a marine vehicle to be moored thereto. Thereafter a mooring line may be attached to the adjustable rope. In practicing the method of the present invention, as the tide level changes, the device rises and lowers to accommodate such changes. However, the relative vertical positions of the annular ring (tie point) of the present device, and the position of a boats engaged cleats will not change. Therefore, changes in tides will not result in any stress or strain on mooring lines, boats or pilings when boats are moored to fixed pilings, pilings which do not move up and down with changing tides since they are driven into the earth (or bed) below a body of water. In addition, the bulbous buoyant base and cylindrical sleeve are highly efficient at protecting both boat and piling from collisions therebetween due to the fact that the sleeve circumferentially covers the pole above the water line.

DETAILED DESCRIPTION

Figure 1:
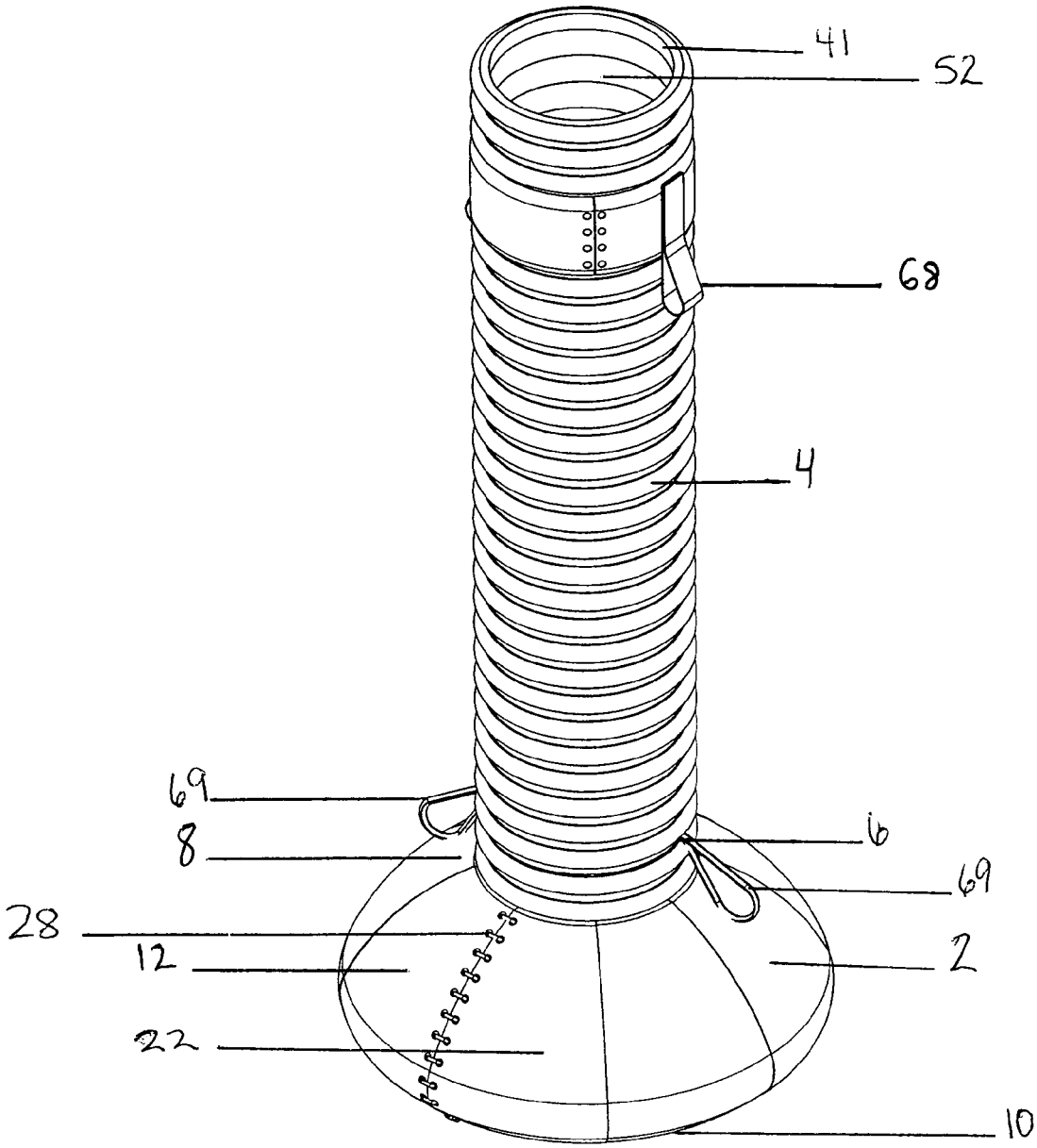
FIG. 1 is an isometric view of a preferred embodiment of the mooring pole device of the present invention
Figure 2:
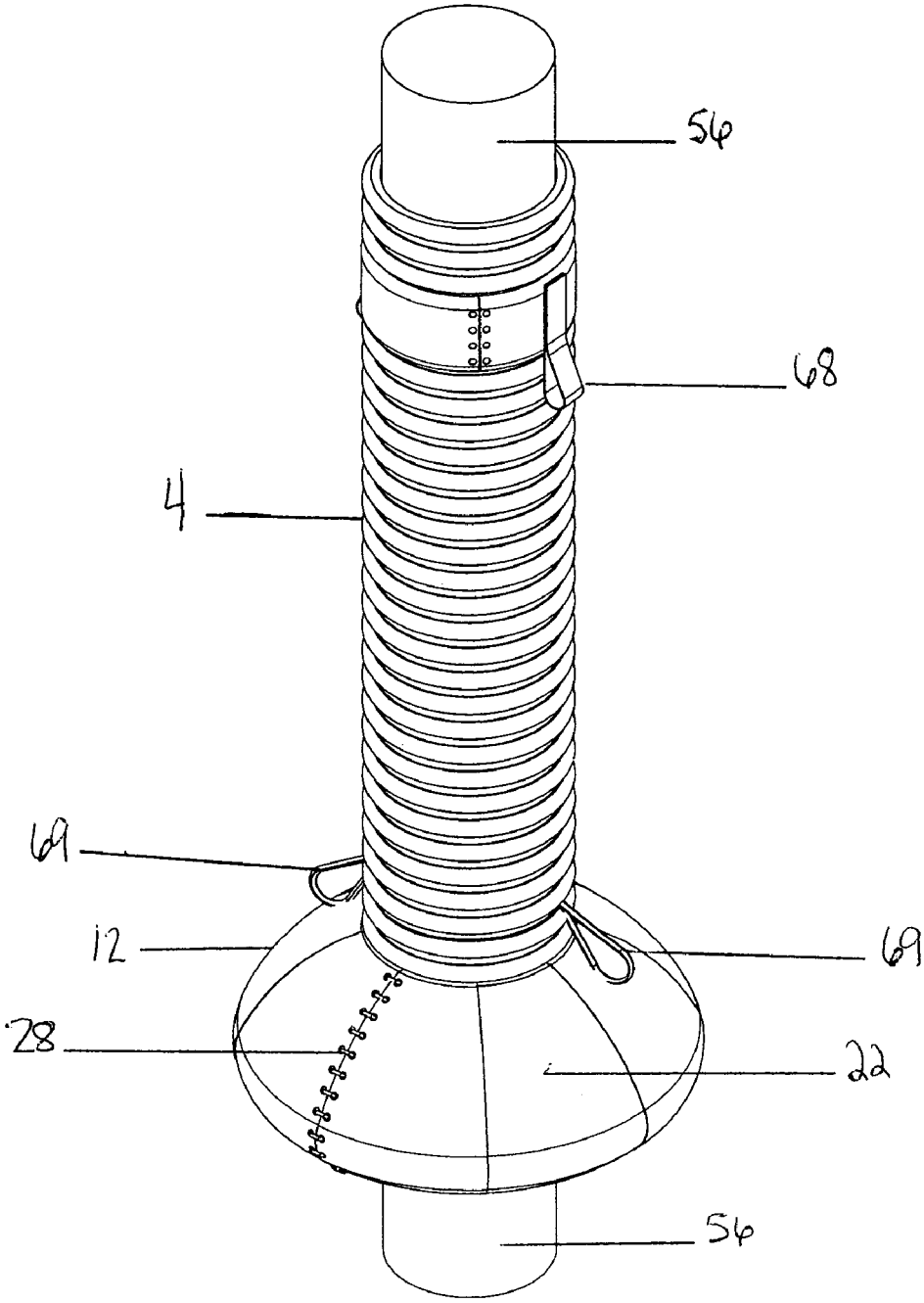
FIG. 2 is an isometric view of the device illustrated in FIG. 1 installed upon a mooring pole.
Figure 3:
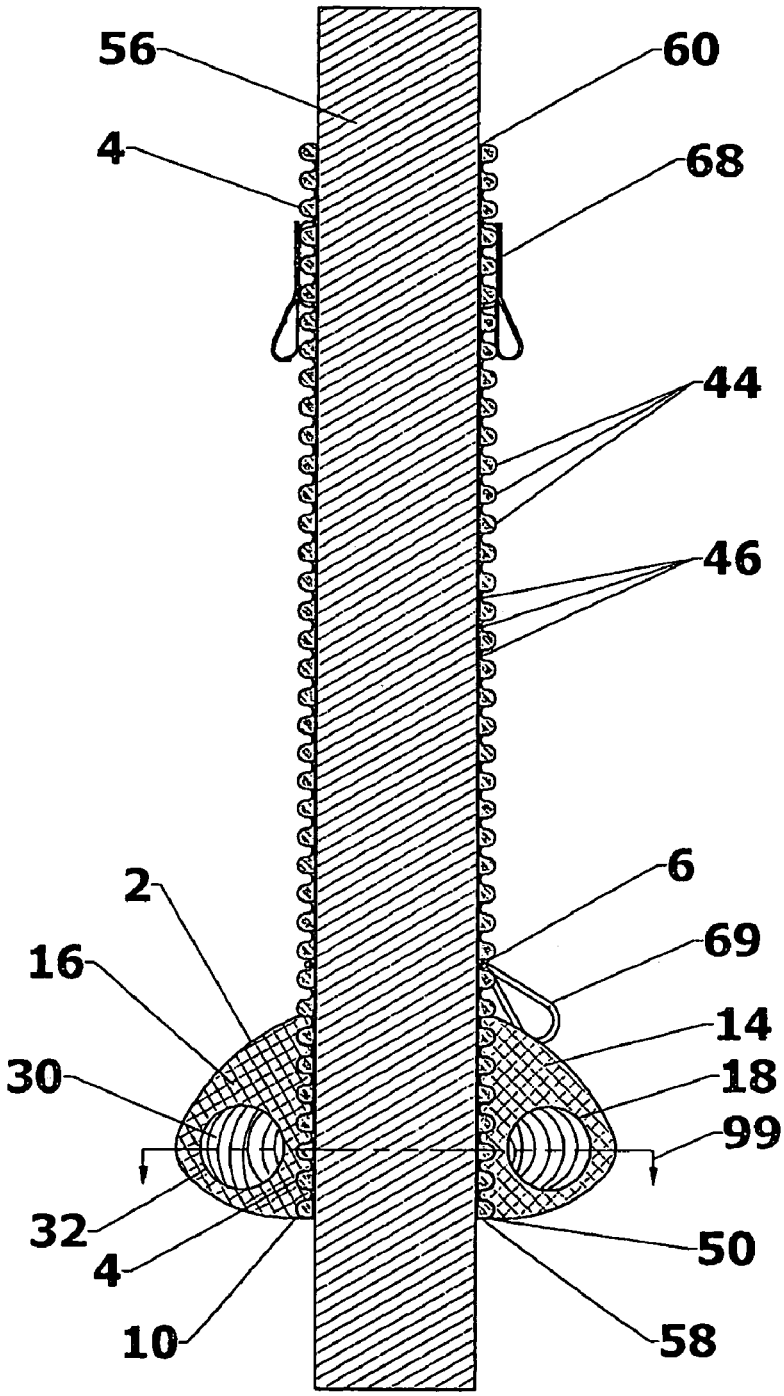
FIG. 3 is a section view of the device illustrated in FIGS. 1–2.
Figure 4:
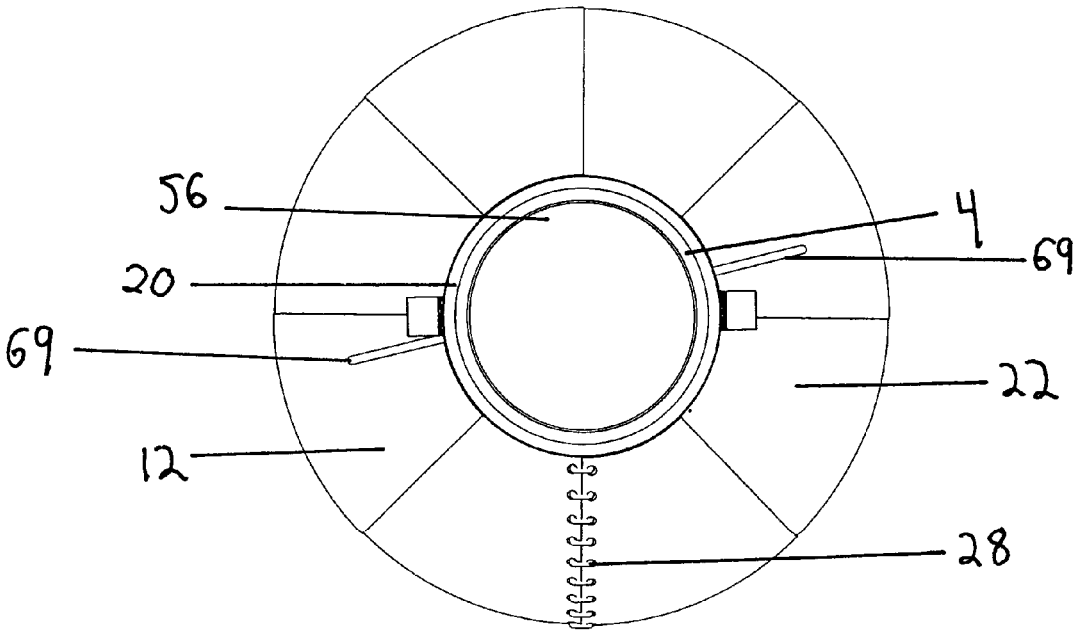
FIG. 4. is a top view of the device illustrated in FIG. 2 installed upon pole.
Figure 5:
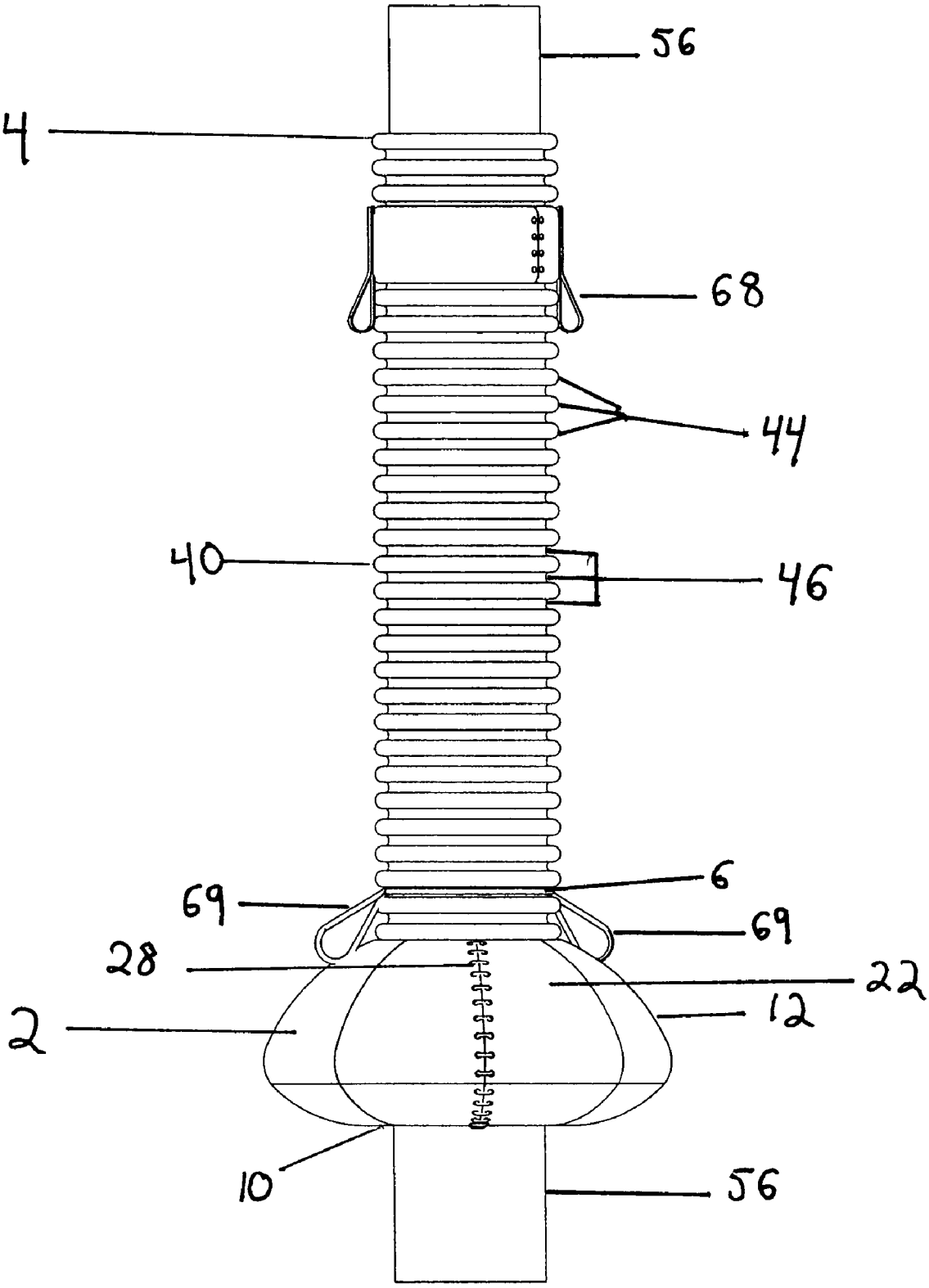
FIG. 5. is a front view of device of FIG. 1 also mounted upon a mooring pole
Figure 6:
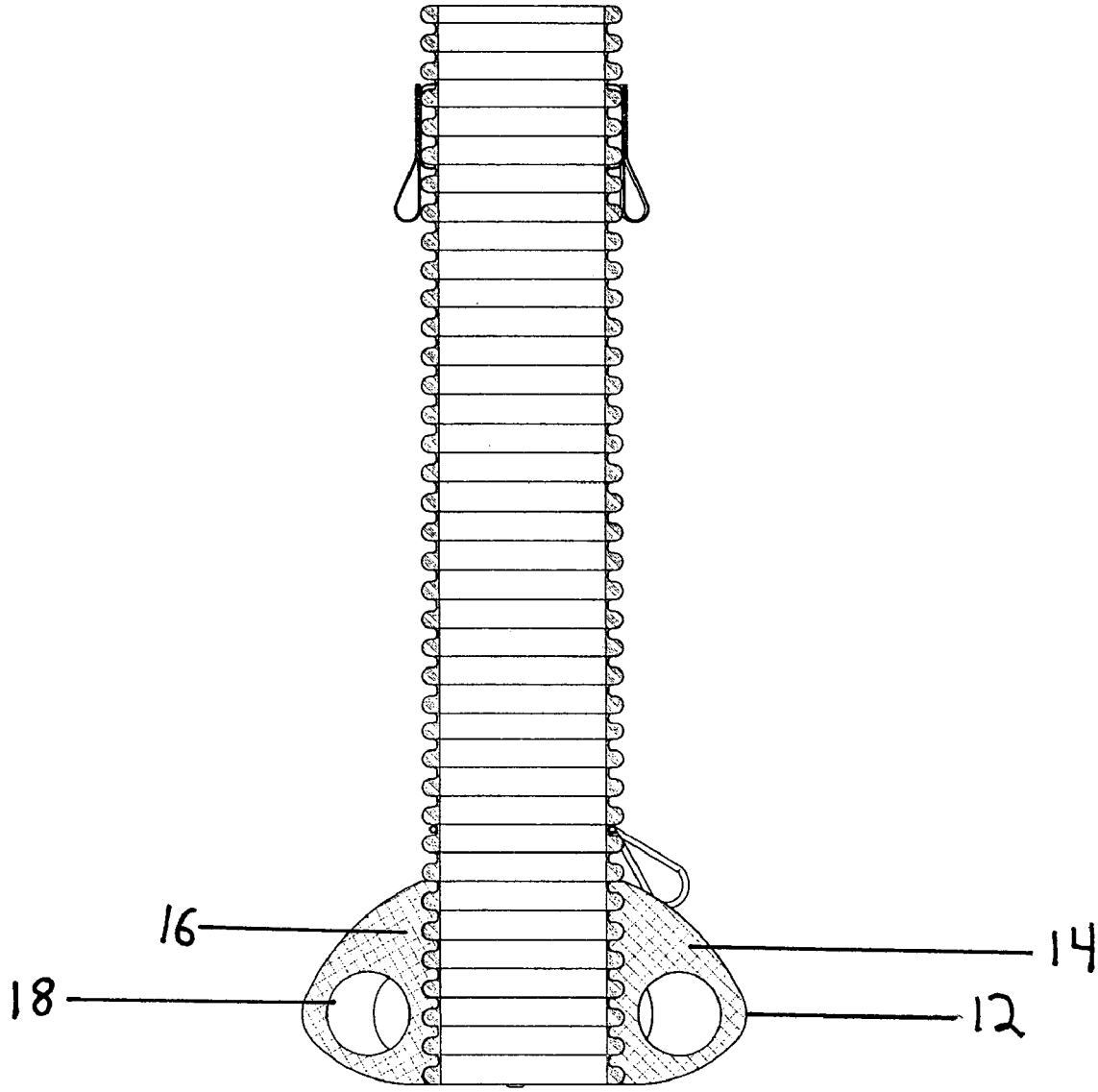
FIG. 6 is a sectional view of the device illustrated in FIGS. 1 to 2.
Figure 7:
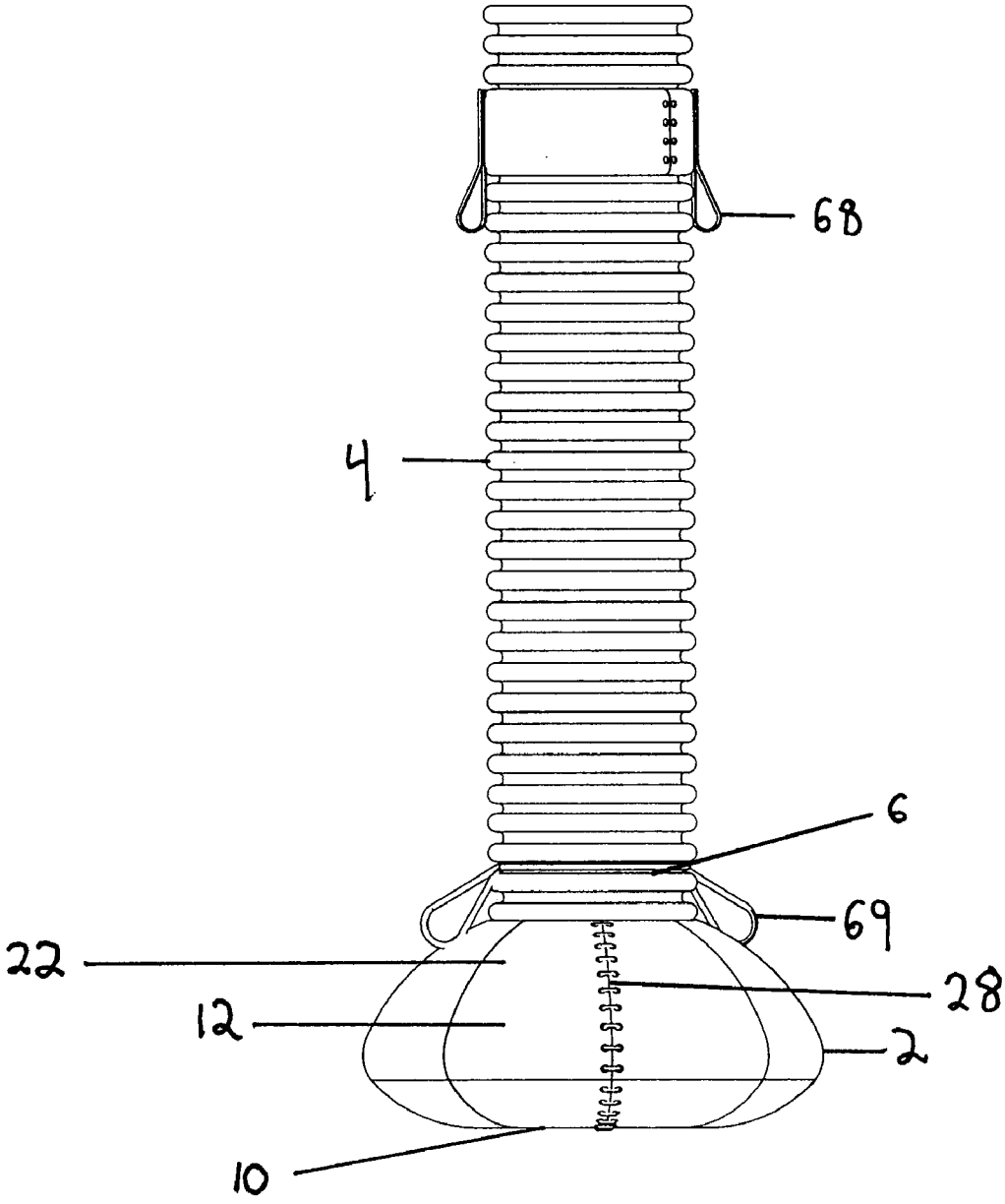
FIG. 7. is a front view of the device illustrated in FIG. 1
Figure 8:
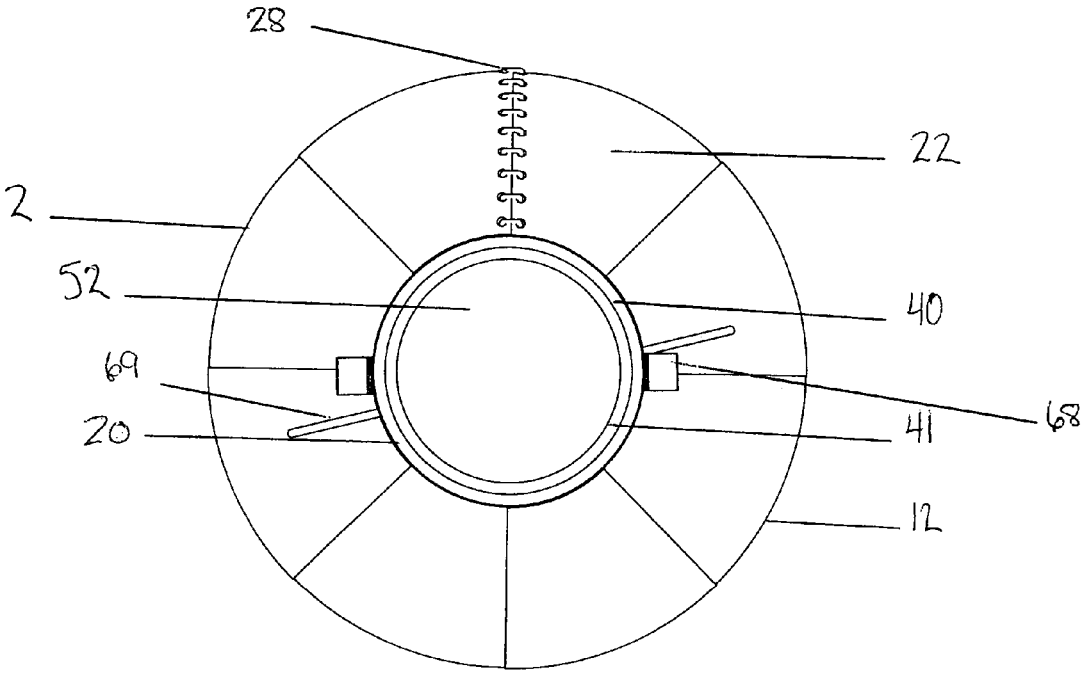
FIG. 8 is a top view of the device illustrated in FIG. 1.
Figure 9:
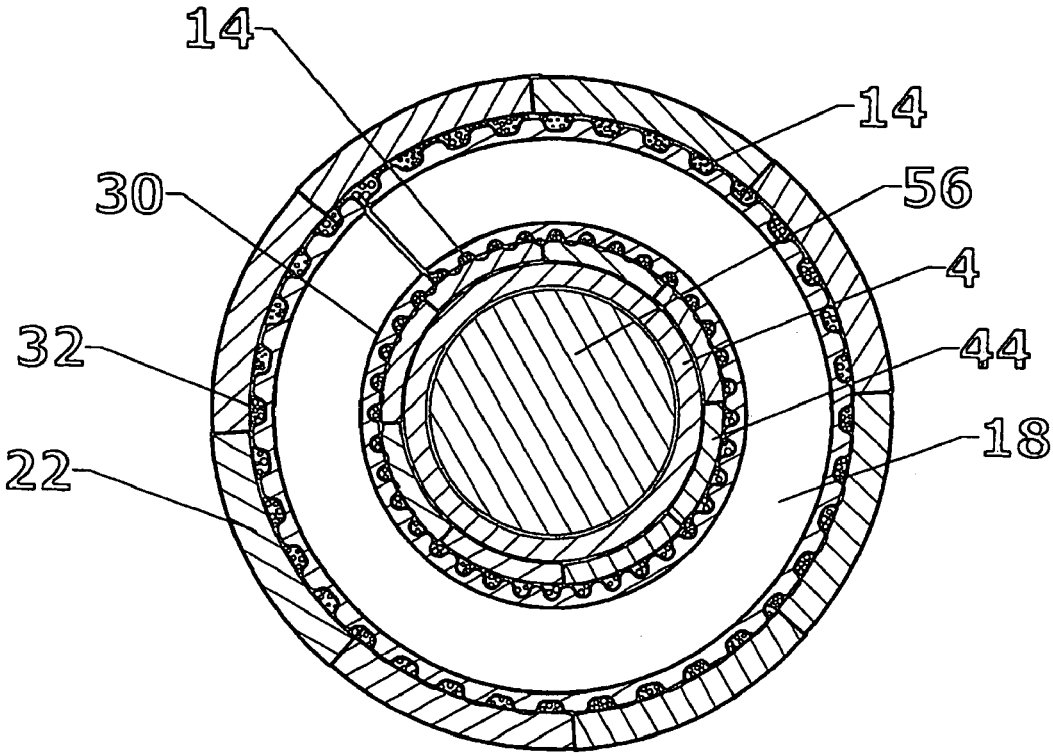
FIG. 9 is a too sectional view of the device illustrated in FIG. 3 as viewed at section line 99.

FIGS. 1 through 8 illustrate a preferred embodiment of the mooring device of the present invention. As described above, the mooring pole line attachment device of the present invention is comprised of a buoyant base 2, cylindrical sleeve 4 and at least one line engagement means 6. The buoyant base includes a superior 8 (distal) and inferior 10 (proximal) terminus. The base is configured as a rather bulbous tubular shape (a "donut shape") and includes an outer surface 12 and an inner core 14. The inner core is filled with a buoyant material 16, inner coil 18 and includes a central bore 20 or, as it is also referred to with equal meaning, throughout this specification and claims, an "inner bore."

The outer surface 12 of the buoyant base is advantageously covered by a tough, resilient cover 22, suitable for marine use such as, for example, a polyvinyl, polyester or nylon, natural rubber or nitrile rubber composition may be utilized. However, both the superior terminus and inferior terminus of the buoyant base include a central opening contiguous with the central bore 20.

The cover 22 may be fabricated of one or more sections and tied 28 (or otherwise affixed) to the outer surface 12 of the buoyant base 2. The inner core 14 of the buoyant base 2 includes an inner coil 18. The inner coil comprises a hollow tube circumferentially aligned in relation to the cylindrical sleeve having an inside 30 and outside 32 surface. The outside surface of the inner coils advantageously includes a plurality of parallel, circumferential rings and parallel grooves therebetween for enhancement of fixation of the buoyant base to the cylindrical sleeve. Thus, when assembled, the circumferential grooves and rings (also referred to, throughout this specification and within the claims as "annular rings" of the inner coil are adjacent and perpendicular to the parallel circumferential rings 44 and grooves 48 (also referred to, collectively, as "annular rings") of the cylindrical sleeve along the length of the sleeve encircled by the buoyant base.

The inner core 14 of the buoyant base is substantially filled with a buoyant material 16—such as a cured foam material—having a density (and thus specific gravity) less than that of water. It is preferred that such buoyant materials demonstrate a specific gravity of from about 0.1 to about 60 $lb/ft^3$. However, it is still further preferred that such foam be selected to have a density of from about 1.5 to about 2.5 $lb/ft^3$. It is, in addition, highly advantageous to select a closed cell foam which, by nature, resists uptake of water. It is also highly advantageous to utilize an injection process in order to fill the buoyant base with the foam material. For this purpose, injection openings may be provided within the outer cover of the buoyant base as well as within the cylindrical sleeve, proximal to the inferior terminus thereof.

As mentioned above, the buoyant base 2 defines a substantially tubular, or, as it may be better described, a "donut-like" shape including and defining a central bore 20. The central bore 20 of the buoyant base surrounds a proximal portion of the cylindrical sleeve 4 of the device as serves as the location and interface of attachment of these two structures by means of the buoyant material which fills both the buoyant base and the annular rings of the external surface of the columnar sleeve adjacent the base. Thus, the inner bore of the buoyant base is selected to demonstrate a inside diameter sufficient to mate with the outside diameter of the cylindrical sleeve. Fixation of the buoyant base to the cylindrical sleeve may be accomplished, for example, by first introducing the inferior (proximal) terminus 50 of the cylindrical sleeve into the central bore 20 of the buoyant base until the inferior terminus of the sleeve is aligned with the inferior terminus of the base 10. Therefore, the annular rings of the outer surface of the cylindrical sleeve face are perpendicular and adjacent to annular rings of the outside surface of the inner coil of the buoyant base. Thereafter, injection points (or openings) located within the cylindrical sleeve in the vicinity of the inferior terminus thereof, allows for the injection of buoyant material through the sleeve and into the core of the buoyant base. The buoyant material substantially fills the entire core of the base, including areas between the annular rings of the inner coils as well as the areas between the annular rings of the cylindrical sleeves in contact with the core. Curing of such material effectively affixes the buoyant base to the sleeve.

As described above, the cylindrical sleeve is configured as a hollow tubular structure with an 40 outer surface and an 41 inner surface defining a central bore 52. The outer surface of the cylindrical sleeve 40 is shaped and configured to include a plurality of continuous parallel rings and grooves therebetween (also referred to throughout this specification and within the claims, with equal meaning as "annular rings)—arranged circumferentially about said outer surface. In contrast, the inner surface 41 of the cylindrical sleeve defines a relatively smooth surface. The cylindrical sleeve may be fabricated of any marine quality material such as, for example, an ABS, polyvinyl, polyether, polyurethane, polypropylene, polyolefin, or polyester plastic. The sleeve may be also fabricated from a natural rubber or a synthetic rubber such as, for example, a nitrile rubber compound.

The smooth inner surface of the cylindrical sleeve (and the central bore defined thereby) are especially sized and configured so as to allow the device (with cylinder attached to base) to slide easily over a mooring pole 56 without causing any damage thereto. The smooth inner surface of the cylindrical sleeve runs from the inferior 58 (or proximal) to the superior 60 (or distal) terminus of the device thereby allowing the entire device to be placed upon and slide up and down a mooring pole.

As mentioned above, the annular (or parallel circumferential) grooves of the cylindrical sleeve serves two distinct purposes. During the above-described fabrication of the mooring pole device, an inferior portion of the outer surface of the sleeve is passed through the superior terminus of the central bore of the buoyant base section (prior to injection of foam therein). At this point in the fabrication process, the buoyant base includes the above-described outer cover, an inner circumferential coiled tube (similar to the columnar sleeve, but of a more diminutive diameter). The coiled tube within the base defines the central bore of the buoyant base and provides a dimension thereto sufficient so as to allow the sleeve to fit matingly therewithin, substantially flush with the proximal terminus thereof.

The annular rings of the present device provide mooring line tie points of varying heights (in regard to water level) so as to accommodate boats of varying sizes and freeboard dimension. Mooring lines from such boats may be tied about a particular circumferential groove in accordance with the relative height of the boat cleat or tie point utilized. In such instances, the groove itself becomes the line engagement means. In addition, the device of the present invention may include a separate line engagement means in addition to the groove alone such as, for example, an adjustable engagement rope 66 tied circumferentially about a selected annular groove. The adjustable rope is configured to include one or more line engagement loops 69 through which mooring lines may be past in order to secure a boat. The adjustable rope is tied so as to allow it to be moved superiorly or inferiorly within selected grooves located along the outer sleeve so as to accommodate the afore-mentioned varying boat dimensions. As mentioned above, the adjustable engagement rope, and loops thereupon, may be utilized as grab handles for individuals (such as swimmers or those fallen overboard) in distress or to aid in mooring a boat.

The device may optionally include a mooring line storage device such as, for example, a simple velcro or snap lock nylon strap 68 affixed near the superior portion of the device so as to allow mooring lines to be left high and dry at the pole.

I claim:

1. A mooring pole line attachment device having a inferior and superior terminus comprised of a buoyant base, cylindrical sleeve and at least one line engagement means wherein the buoyant base includes a superior terminus, an inferior terminus, a core having an inner coil therewithin configured with parallel rings and circumferential grooves located upon the outer surface thereof and wherein the buoyant base further includes a central bore having an inside diameter especially configured to enable a portion of the cylindrical sleeve, adjacent to an inferior terminus thereof, to be inserted therewithin, wherein said core and the circumferential grooves of the outer surface of the inner coil are filled with a buoyant material having a specific gravity less than that of water;

the cylindrical sleeve having a length and an outside diameter and including a superior terminus, an inferior terminus, an outer surface and an inner surface wherein the inner surface is substantially smooth and the outer surface includes a plurality of parallel circumferential rings, said rings defining parallel circumferential grooves therebetween, wherein the outside diameter of the cylindrical sleeve is especially configured so as to enable a portion of the cylindrical sleeve, adjacent to the inferior terminus thereof, to be inserted within the central bore of the buoyant base and wherein the parallel rings and circumferential grooves adjacent the inferior terminus of said cylindrical sleeve are disposed in a perpendicular relation to the parallel rings and grooves of the inner coil, said buoyant material also filling the parallel grooves of the cylindrical sleeve so as to affix said buoyant base to said cylindrical sleeve; and the line engagement means includes a means of adjustment thereto wherein said means may be repositioned from one circumferential ring to another along the length of the cylindrical sleeve wherein said device rises and lowers in accordance with changes in tide level so as to allow boats to be moored to a fixed mooring pole.

2. The mooring pole line attachment device of claim 1 wherein the buoyant base is filled with a material having a specific gravity less than that of water.

3. The mooring pole line attachment device of claim 2 wherein said material having a specific gravity less than that of water comprises a plastic foam material.

4. The mooring pole line attachment device of claim 3 wherein said plastic foam material is selected from the group including thermal plastic foams including polystyrene, polyvinylchloride, polyethylene, polypropylene and ABS plastic.

5. The mooring pole line attachment device of claim 4 wherein said plastic foam material comprises a closed foam material.

6. The mooring pole line attachment device of claim 5 wherein said closed plastic foam material demonstrates a density of from about 0.1 to about 60 $lb/ft^3$.

7. The mooring pole line attachment device of claim 6 wherein said closed plastic foam material demonstrates a density of from about 1.5 to about 2.5 $lb/ft^3$.

8. The mooring pole line attachment device of claim 1 wherein the buoyant base includes an outer cover.

9. The mooring pole line attachment device of claim 8 wherein the outer cover of the buoyant base is fabricated from a plastic material.

10. The mooring pole line attachment device of claim 9 wherein the plastic material from which the outer cover is fabricated is selected from the group including polyvinyl, polyolefin, polypropylene, polyester, polyurethane or nylon material.

11. The mooring pole line attachment device of claim 8 wherein the outer cover of the buoyant base is fabricated from a rubber compound.

12. The mooring pole line attachment device of claim 11 wherein the rubber compound is selected from the group comprising natural rubber and nitrile rubber compounds.

13. The mooring pole line attachment device of claim 1 wherein the cylindrical sleeve is comprised of a plastic material.

14. The mooring pole line attachment device of claim 13 wherein the plastic material is selected from the group comprised of ABS, polyvinyl, polyether, polyurethane, polypropylene, polyolefin, or polyester plastics.

15. The mooring pole line attachment device of claim 1 wherein the cylindrical sleeve is comprised of a rubber compound.

16. The mooring pole line attachment device of claim 15 wherein the rubber compound is selected from natural and nitrile rubber compounds.

17. The mooring pole line attachment device of claim 1 wherein the line engagement means comprises an engagement rope, tide about the outer surface of the cylindrical sleeve and lying with a selected circumferential groove.

18. The mooring pole line attachment device of claim 1 Wherein the engagement rope includes at least one line receiving loop thereupon for engagement of a mooring line.

* * * * *